United States Patent [19]

Rossitto et al.

[11] 3,990,600

[45] Nov. 9, 1976

[54] TANK CONSTRUCTION

[75] Inventors: Vincent J. Rossitto, Buffalo; Robert E. Baker, North Evans; James J. Jarvis; James N. De Serio, both of Kenmore, all of N.Y.

[73] Assignee: Metal-Cladding, Inc., North Tonawanda, N.Y.

[22] Filed: Aug. 14, 1975

[21] Appl. No.: 604,828

Related U.S. Application Data

[62] Division of Ser. No. 448,669, March 6, 1974, Pat. No. 3,917,104.

[52] U.S. Cl. ..... 220/5 A; 220/1 B; 220/69; 220/71

[51] Int. Cl.[2] ..... B65D 7/02; B65D 7/42; B65D 89/02; B65D 89/12

[58] Field of Search ..... 220/5 R, 5 A, 1 B, 66, 220/69, 70, 72, 73

[56] References Cited

UNITED STATES PATENTS

| | | | |
|---|---|---|---|
| 2,905,350 | 9/1959 | Edwards | 220/70 X |
| 3,419,184 | 12/1968 | Asenbauer | 220/355 X |
| 3,804,289 | 4/1974 | Churan | 220/72 X |

*Primary Examiner*—William Price
*Assistant Examiner*—Steven M. Pollard
*Attorney, Agent, or Firm*—Sommer & Sommer

[57] ABSTRACT

An improved upstanding cylindrical tank is provided, in one aspect of the invention, with a ring-like stiffening member at its open upper end to resist flexure and deformation of the side wall structure under wind loading. The stiffening member has a cylindrical inner flange portion formed integrally with the tank wall, an annular web portion extending radially outward from an upper part of the upper flange portion, and a cylindrical outer flange portion depending from an outer part of the web portion and arranged concentrically with the inner flange portion. The stiffening member has a minimum vertical moment of inertia and is configured to have its vertical neutral axis located approximately midway between the furthermost fibers of the inner and outer flange portions.

A tank is provided, in another aspect of the invention, with means for resisting an overturning moment which produces additional tensile forces in a leading portion of the wall structure and additional compressive forces in a trailing portion thereof. The resisting means are arranged near the bottom of the tank and include vertically-spaced upper and lower annular flanges extending radially outwardly from the side wall structure, and a plurality of circularly-spaced anchor bolts arranged to act on the upper flange to resist the additional tensile forces. The centroid of the polar moment of inertia of the resisting means is located equidistant from the furthermost fibers of the upper and lower flanges.

4 Claims, 19 Drawing Figures

Fig. 1.
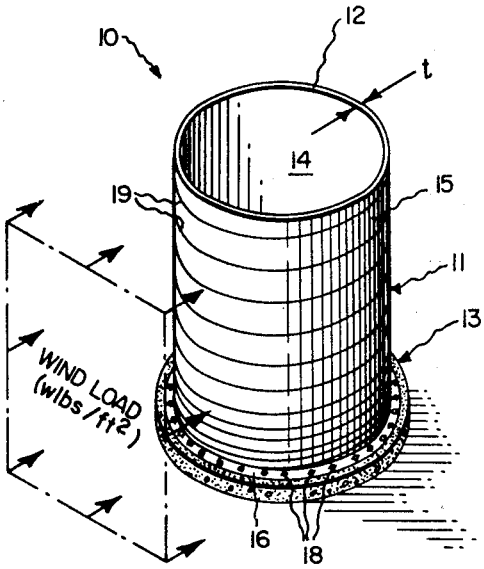
Fig. 2.
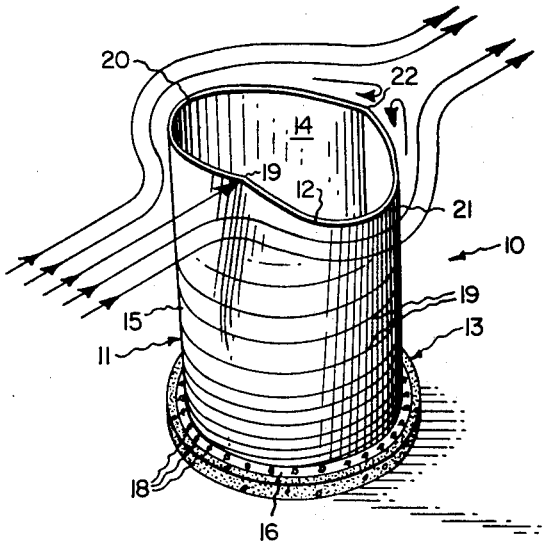
Fig. 3.
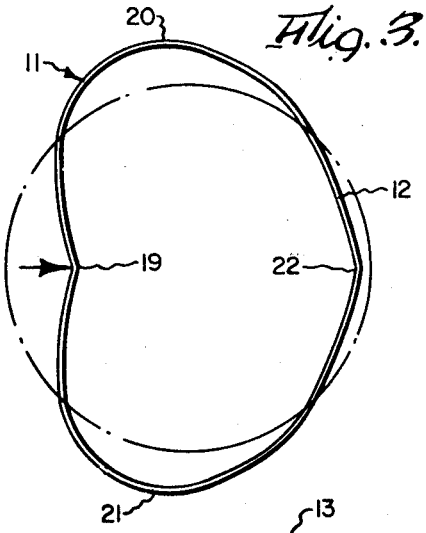
Fig. 4.
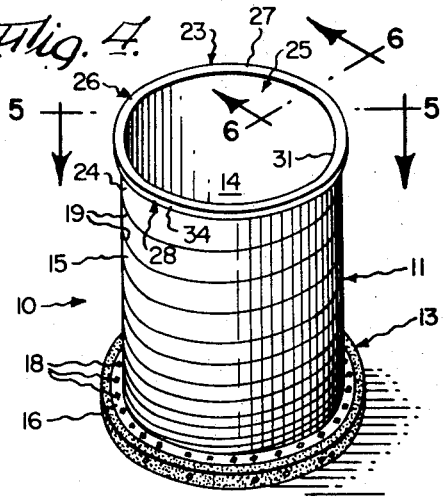
Fig. 5.
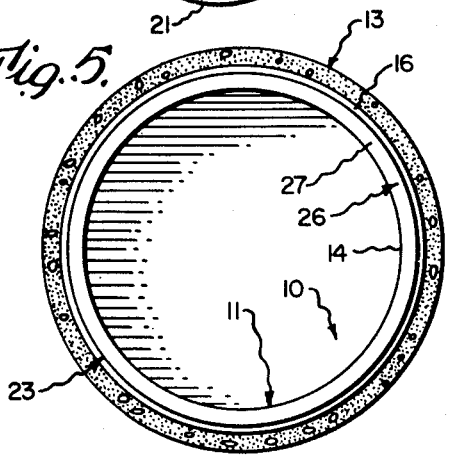
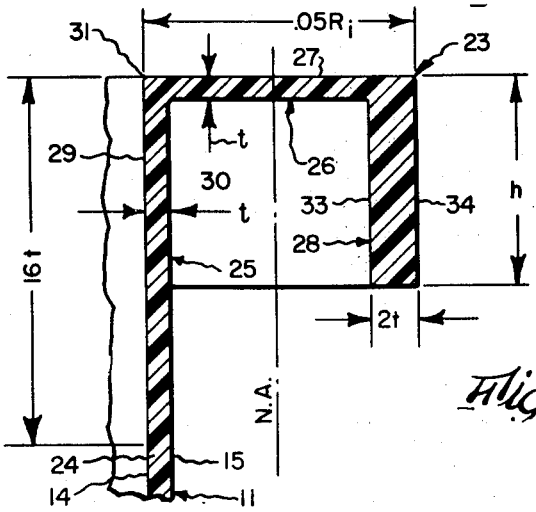
Fig. 6.

Fig. 11.
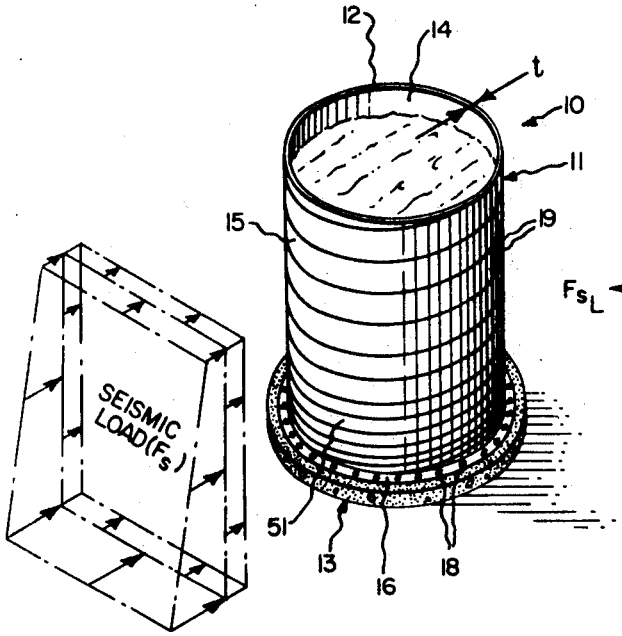
Fig. 12.
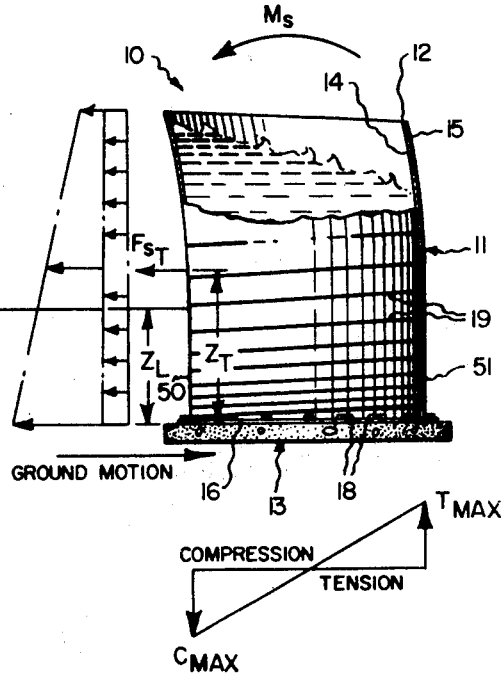
Fig. 13.
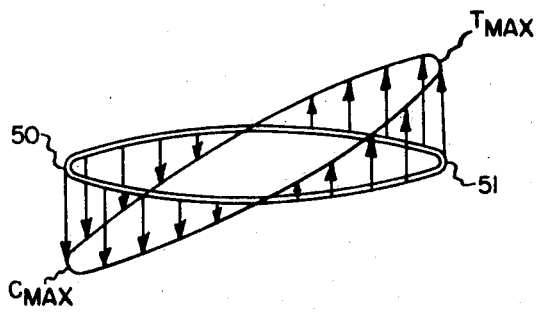
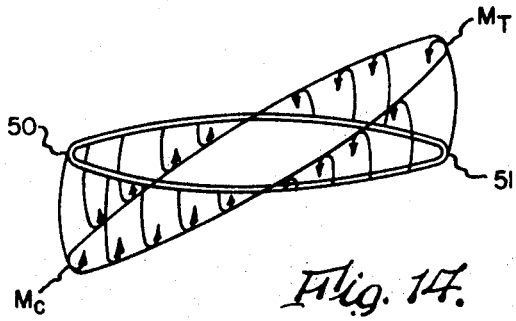
Fig. 14.
Fig. 15.
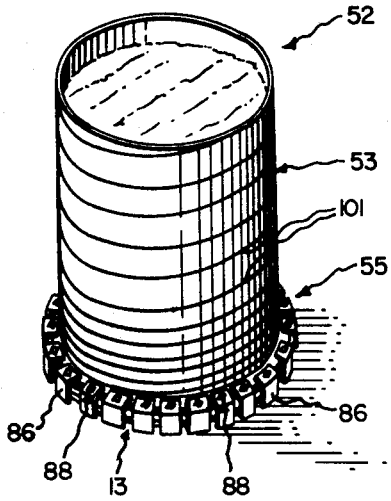

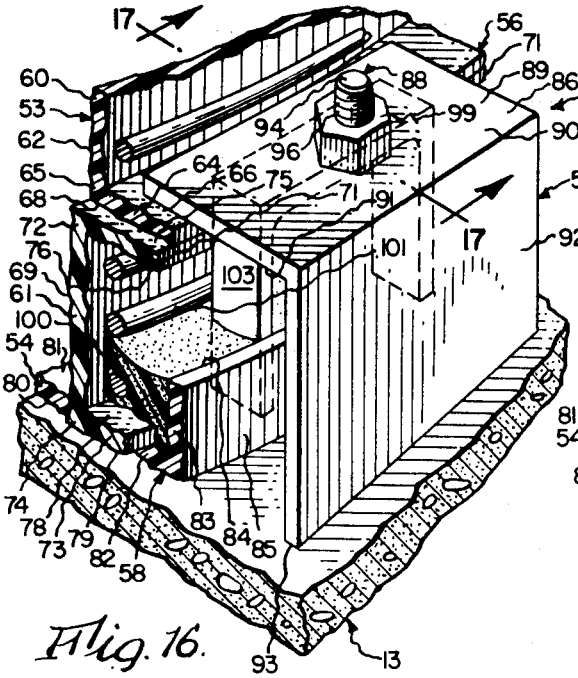
Fig. 16.
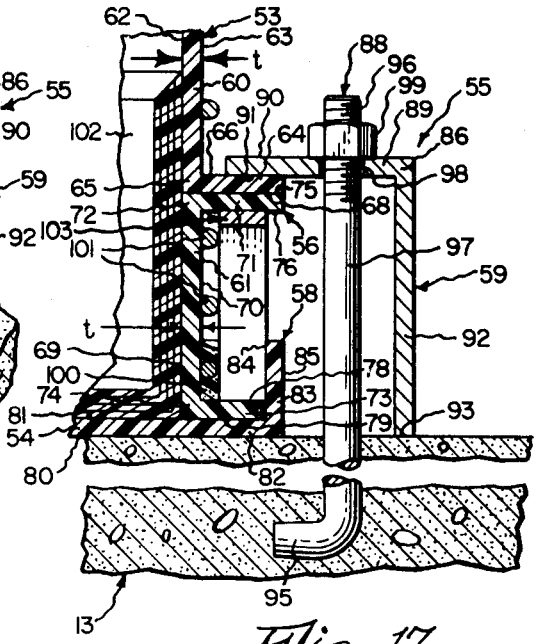
Fig. 17.
Fig 18.
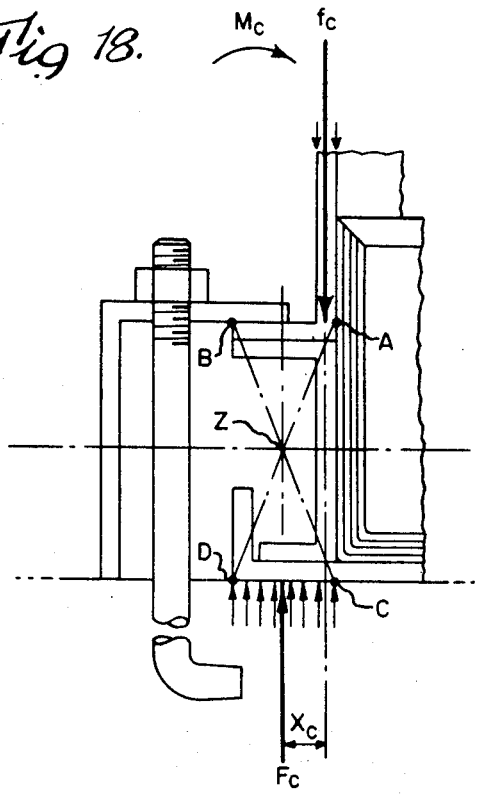
COMPRESSION SIDE
Fig. 19.
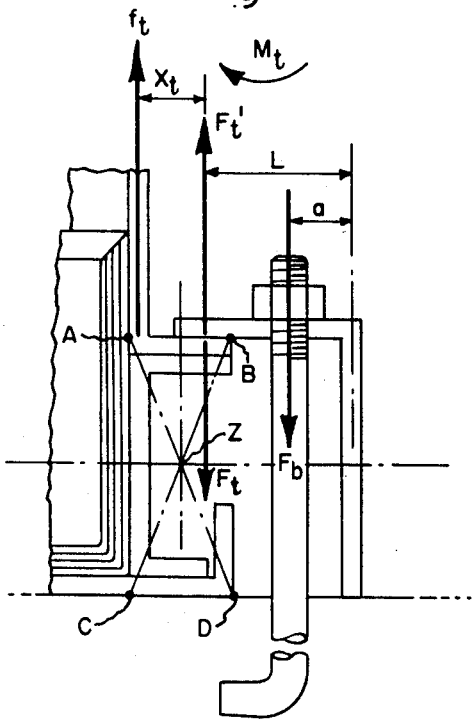
TENSION SIDE

TANK CONSTRUCTION

This is a divisional application of pending application Ser. No. 448,669, filed Mar. 6, 1974, now U.S. Pat. No. 3,917,104.

BACKGROUND OF THE INVENTION

The present invention relates to improvements in tank constructions, particularly in upstanding open-top cable-wrapped fiberglass reinforced plastic tanks of the type disclosed in U.S. Pat. No. 3,025,992 which are especially suited to contain or store corrosive liquids.

This form of tank construction includes a cylindrical wall structure which may be formed and transported sectionally and thereafter assembled in situ. A steel cable is helically wrapped around the tank such that the vertical spacing between adjacent cable convolutions is closer near the bottom of the tank than at the top. Since this external cable operatively resists the hoop stress exerted on the tank wall by the liquid contained within the tank, the sectional wall structure may be manufactured to have an economically thin radial thickness.

However, as the wall structure is relatively thin in comparison to the tank diameter and height, the wall structure of the assembled tank is relatively flexible, particularly at its open upper end, and may deform or flex under normal wind loading when the tank is empty.

Moreover, such a tank, and other types of tank constructions, may have to be designed to resist seismic forces and wind forces which apply an overturning moment to the tank. Under application of such seismic forces, liquid within the tank may exert a hydrodynamic impulse on the wall structure, producing a tensile force in one portion thereof and a compressive force in another portion thereof.

SUMMARY OF THE INVENTION

The present invention, in one aspect, relates to improvements in upstanding thin-walled fiberglass reinforced plastic (FRP) tanks, adapted to contain or store a liquid or fluid material and having an annular side wall structure terminating in an annular rim at its open upper end, and wherein a portion of such structure is configured as a cylindrical segment having an upper arcuate end forming a part of the rim.

The invention provides a stiffening member located at the upper end of the segmented portion for increasing the flexure resistance thereof proximate the rim. The stiffening member includes an inner flange portion configured as a cylindrical segment and secured to the segmented portion and extending upwardly therefrom; a web portion formed integrally with and extending radially outward from an upper part of the inner flange portion; and an outer flange portion configured as a cylindrical segment formed integrally with and depending from an outer part of the web portion and arranged generally concentric with and spaced radially from the inner flange portion.

Preferably, the inner flange portion is formed integrally with the segmented portion and has a vertical height of at least sixteen times its radial thickness. The web portion may have a vertical thickness equal to the radial thickness of the inner flange portion, and a radial extent of one-twentieth of the inner radius of the segmented portion. The radial thickness of the outer flange portion is desirably twice the radial thickness of the inner flange portion.

The minimum value of the vertical moment of inertia is computable as a function of the anticipated wind load, the outer diameter of the side wall structure, and Young's modulus for FRP. After the minimum moment of inertia has been computed, the vertical height of the outer flange portion may be dimensioned to locate the neutral axis of the vertical moment of inertia approximately midway between the furthermost fibers of the inner and outer flange portions.

The present invention, in a second aspect, provides resisting means at the lower portion of a tank for withstanding an overturning moment applied thereto, such moment producing tensile forces in a leading portion of the wall structure and compressive forces in a trailing portion thereof.

The resisting means includes annular lower flange means extending outwardly from the tank and having a lower face arranged in downwardly thrusting relation to a support, annular upper flange means extending outwardly from the tank and arranged in vertically-spaced relation to the lower flange means, and anchorage means secured to the support and arranged to exert a downward force on the upper flange means. The lower face of the lower flange means is arranged to resist the compressive force in the trailing portion of the wall structure.

The anchorage means includes a plurality of circularly-spaced bolt means arranged to act on the upper surface of the upper flange means through an intermediate contact plate. In one embodiment, the bolt means includes a plurality of anchor bolts having their lower ends suitably embedded in the support, and a corresponding plurality of nuts threaded onto the upper ends of each of the anchor bolts and arranged to act on the upper surface of the plate. The anchorage means cooperates with the upper flange means to resist the additional tensile forces produced in the leading part of the wall structure.

The resisting means is configured to locate the centroid of its polar moment of inertia approximately equidistant from the furthermost fibers of the upper and lower flange means.

Accordingly, one object of the present invention is to provide a stiffening member to resist deformation of the upper rim of an open-top, relatively-flexible, upstanding tank under application of wind loads.

Another object is to provide an improved tank capable of withstanding application of an overturning moment which produces tensile forces in a leading portion of the side wall structure and compressive forces in a trailing portion thereof.

These and other objects and advantages will become apparent from the foregoing and ongoing specification which includes the drawings and the appended claims.

BRIEF DESCRIPTION OF THE DRAWINGS

FIG. 1 is a perspective view of an empty, upstanding, open-top, thin-walled cylindrical, fiberglass reinforced plastic tank to which a uniformly distributed unidirectional wind load is about to be applied.

FIG. 2 is a perspective schematic view of the tank depicted in FIG. 1 after application of the wind load and particularly illustrating the nature of the deformation of the annular side wall structure and further illustrating a schematic flow gradient about the upper rim of the deformed tank.

FIG. 3 is an isolated top plan view of the deformed rim shown in FIG. 2, depicting the extent of such rim deformation from its original circular shape, such original undeformed shape being shown in phantom.

FIG. 4 is a perspective view of an improved empty, upstanding, open-top, thin-walled, cylindrical fiberglass reinforced plastic tank, generally similar to the tank depicted in FIG. 1 but additionally provided with the inventive stiffening member.

FIG. 5 is an enlarged top plan view of the improved tank, taken on line 5—5 of FIG. 4, and particularly showing the annular web portion of the stiffening member.

FIG. 6 is an enlarged fragmentary vertical sectional view of the upper portion of the cylindrical wall structure of the tank, taken on line 6—6 of FIG. 4, such view illustrating the stiffening member in cross-section.

FIG. 11 is a perspective view of the tank depicted in FIG. 1 shown containing a liquid and to which a horizontal distributed trapezoidal seismic load is about to be applied.

FIG. 12 is an exaggerated schematic representation of a side elevation of the tank after application of the seismic load depicted in FIG. 11 and having a portion of the wall structure broken away to illustrate the liquid exerting a dynamic impulse on the wall structure, such impulse placing the leading or right portion of the wall structure in tension and the trailing or left portion thereof in compression.

FIG. 13 is a perspective schematic view of a lower part of the wall structure depicted in FIG. 12, showing the point of maximum tension in the leading or right portion, and the point of maximum compression in the trailing or left portion.

FIG. 14 is a perspective schematic view of the rotational moments produced in the wall structure due to the tensile and compressive forces depicted in FIG. 13.

FIG. 15 is a perspective view of an improved tank, generally similar to the tank depicted in FIG. 11, but provided with the inventive resisting means.

FIG. 16 is an enlarged fragmentary perspective view of a portion of the resisting means illustrated in FIG. 15, this view particularly illustrating the upper and lower flange means and the anchorage means.

FIG. 17 is a fragmentary vertical sectional view of the lower portion of the tank, taken on line 17—17 of FIG. 16, and showing the resisting means in cross-section.

FIG. 18 is a schematic fragmentary vertical sectional view of the resisting means at the point of maximum compression and depicting the forces acting therein.

FIG. 19 is a schematic fragmentary vertical sectional view of the resisting means at the point of maximum tension and depicting the forces acting therein.

DESCRIPTION OF THE PREFERRED EMBODIMENTS

Stiffening Member (FIGS. 1-10)

Figure 7:
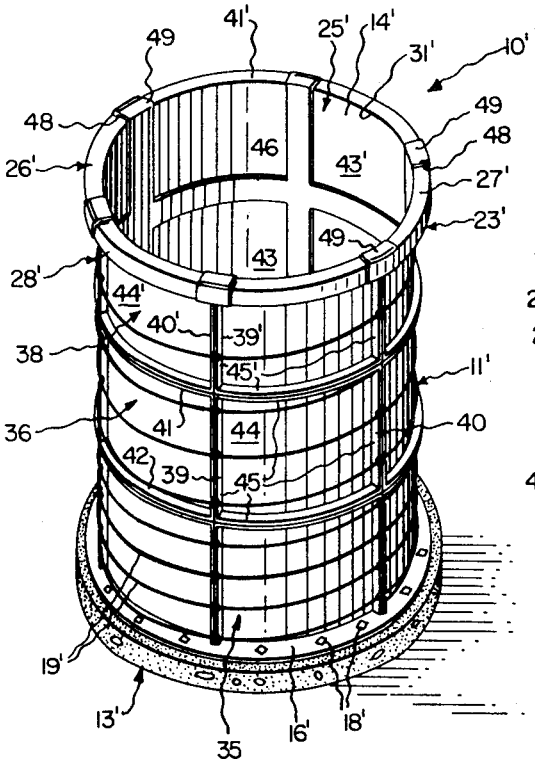
FIG. 7 is a perspective view of an alternative type of tank construction, particularly suited for large capacity tanks, wherein the side wall structure is formed by assembling a plurality of cylindrical segments, each of the upper segments being shown as including the inventive stiffening member.

Referring to FIG. 1, an empty upstanding open-top tank, generally indicated at 10, is depicted as including an annular side wall structure 11 having an annular rim 12 at its open upper end, and a horizontal circular bottom resting on a lower supporting foundation 13. The side wall structure 11 is specifically illustrated as being a thin-walled vertical cylinder having an inner cylindrical surface 14 and an outer cylindrical surface 15 spaced radially therefrom by the thickness ($t$) of the wall structure. A marginal portion 16 of the bottom is shown extending radially beyond the outer surface 15 of the side wall structure. A plurality of circularly-spaced bolts 18 are suitably anchored in the foundation and are arranged to act on the upper surface of marginal portion 16 to secure the tank to the foundation.

Tank 10 is formed of a fiberglass reinforced plastic (FRP) material to provide a high degree of corrosion resistance to various liquids and fluid materials which may be stored therein. In cross-section, such FRP material may preferably include alternate layers of high strength woven roving and 1½ oz. fibrous mat, and one or more inner layers of surfacing mat, such as C-glass, such layers being bonded together with a suitable resin, such as polyester, epoxy, phenolic, furfuryl alcohol. vinylester, or other suitable plastic, to provide a high degree of corrosion resistance to a fluid within the tank. Such serviced fluids might typically include phosphoric acid, muriatic acid, wine, citrus juices, salt solutions, and the like. However, since the modulus of elasticity of FRP is relatively low, being in the order of $1.0 \times 10^6$ psi in tension and $1.25 \times 10^6$ psi in compression, the side wall structure 11 of the tank must be further strengthened to resist the hoop stress exerted by a height of stored liquid acting on the inner surface 14 of the tank. To this end, a steel cable having a greater modulus of elasticity, typically on the order of $21 \times 10^6$ psi, has its lower end suitably anchored (not shown) proximate the bottom of the tank, its intermediate portion helically wound around the outer surface 15 of the tank such that the vertical spacing between adjacent cable convolutions 19 increases with height above the tank bottom, and its upper end suitably secured (not shown) proximate the upper end of the tank. Additional features and details of this known form of cable-wrapped FRP tank construction may be found in U.S. Pat. No. 3,025,992, disclosure of which is hereby incorporated by reference. Large volume storage tanks have been constructed according to the teaching of this patent and, for a cylindrical tank having an inner diameter of twenty (20) feet and a height of twenty-seven (27) feet, a typical economic thickness of the side wall structure might be about one-half (½) inch. The helically wound cable is wrapped loosely around the outer surface of the tank and is designed solely to resist the hoop stress exerted by the service fluid on the wall structure. However, when empty and subjected to wind loads, such tanks are known to experience significant deformation, especially about their open upper ends. Moreover, the side wall structure 11 must be capable of withstanding repeated stress reversals as the direction of the wind changes.

When an assumed unidirectional distributed wind load having a magnitude of $w$ lbs/ft$^2$, as schematically represented in FIG. 1, is applied to the tank, the flow gradient of such wind load around the tank causes the side wall structure 11 to flex or deform to the general shape illustrated in FIG. 2. Since the bottom of the tank is fixed to the foundation by the plurality of anchor bolts 18 acting on flange 16, the circular cross-sectional shape of a lower portion of the side wall structure proximate flange 16 will be maintained. However, the upper rim 12 of the wall structure is unsupported and unrestrained and may distort from its substantially circular shape to the shape of a heart pointing in the leeward direction, as best illustrated in FIG. 3. A static pressure will be applied at the center 19 of the windward side of the rim, causing it to bend sharply inward. The force of such load may cause the lateral portions 20, 21 of the rim to bulge outwardly in a direction generally transverse to the direction of the wind. At the same time, a low pressure region may develop on the leeward side of the rim, urging a central portion 22 thereof to flex sharply outwardly. The intermediate portion of the side wall structure 11 is depicted as being in generally smooth, continuous transition from its restrained circular cross-section proximate the bottom to its heart-shaped cross-section at the upper rim, as best shown in FIG. 2. Maximum stress will occur at points 19, 22 of sharp, discontinuous flexure on the windward and leeward sides of the rim, respectively.

While it is convenient to visualize the wind load as being unidirectional and uniformly distributed, in reality, its direction and magnitude are continuously varying. Hence, the upper rim 12 of the tank being the section of maximum distortion, is subjected to repeated stress reversals which greatly reduce the fatigue life of the tank. Unlike a cylindrical tank of steel or concrete, the wall structure of a large capacity FRP tank is relatively flexible because its radial thickness is typically small with respect to the diameter and height of the tank. It has been observed that the upper rim of an FRP tank may actually quiver or vibrate under normally encountered wind loading, further decreasing the fatigue life of the tank especially at the points of maximum stress concentration in the rim.

In FIG. 4, the tank depicted in FIG. 1 is shown as being additionally provided with the inventive stiffening member 23 to increase the flexural rigidity of its open upper end to resist wind loads. As best illustrated in FIGS. 4–6, the inventive stiffening member 23 is located at the open upper end of the tank and is secured to or formed integrally with an upper part 24 of the cylindrical side wall structure 11.

As best shown in FIG. 6, the stiffening member 23 broadly includes an inner flange portion 25, a web portion 26, and an outer flange portion 28. The inner flange portion 25 is a thin-walled vertical cylinder having an inner cylindrical surface 29, an outer cylindrical surface 30 spaced radially therefrom by the thickness ($t$) of the inner flange portion, and having an open upper end 31. Preferably, inner flange portion 25 is formed integrally with the side wall structure, or a segmented portion thereof, so as to constitute an upward continuation thereof having a vertical height at least sixteen (16) times the radial thickness ($t$) of the side wall structure.

Th web portion 26 is shown as being a horizontal annular plate formed integrally with and extending radially outwardly from an upper marginal part of the inner flange portion proximate the upper end 31 thereof, and as having a vertical thickness equal to the thickness ($t$) of the side wall structure and a horizontal upper annular surface 27. Desirably, the maximum radial extent of the web portion is one-twentieth (0.05) of the inner radius ($R_i$) of the tank.

The outer flange portion 28 is a larger diameter vertical cylinder spaced radially from and arranged concentrically with inner flange portion 25, and formed integrally with and depending from an outer marginal part of the web portion. The outer flange portion 28 has a vertical height ($h$), an inner cylindrical surface 33 and an outer cylindrical surface 34 spaced radially therefrom by the thickness of the outer flange portion, desirably twice the thickness ($t$) of annular side wall structure 11.

In a presently preferred embodiment, the stiffening member 23 is formed integrally with the cylindrical side wall structure 11 such that the inner flange portion constitutes an integral upward continuation thereof. In some applications, it may be desirable to form or assemble the stiffening member separately from the tank and subsequently secure it to the upper end of the wall structure, as by overlapping the inner flange portion of the stiffening member on the inside or outside of the side wall structure.

In FIG. 7, an alternative sectional type of construction, also disclosed in U.S. Pat. No. 3,025,992 and particularly suited for erecting tanks of large height and/or diameter, is shown as including an annular side wall structure 11′ formed by assembling a plurality of annular segments together and about which the convolutions 19′ of a helically wound cable are wrapped. This sectional annular wall structure 11′ is shown as being a thin-walled vertical cylinder and formed by assembling 18 cylindrically-segmented sections into a bottom ring of six lower segments 35, a middle ring of six intermediate segments 36, and a top ring of six upper segments 38, each of such segments being shown as inscribing an arc of 60°. Each intermediate segment 36 is shown as including a vertical left and right side 39, 40, respectively; a horizontal arcuate top and bottom 41, 42, respectively; and inner and outer arcuate surfaces 43, 44, respectively, severally occupying the inscribing angle of 60° and separated by the thickness ($t$) of the segment. These intermediate segments 36 are additionally shown provided with a peripheral mounting flange 45 extending radially outwardly from the top, bottom, and sides thereof, and by which adjacent segments may be held together during assembly of the tank 10′.

Figure 8:
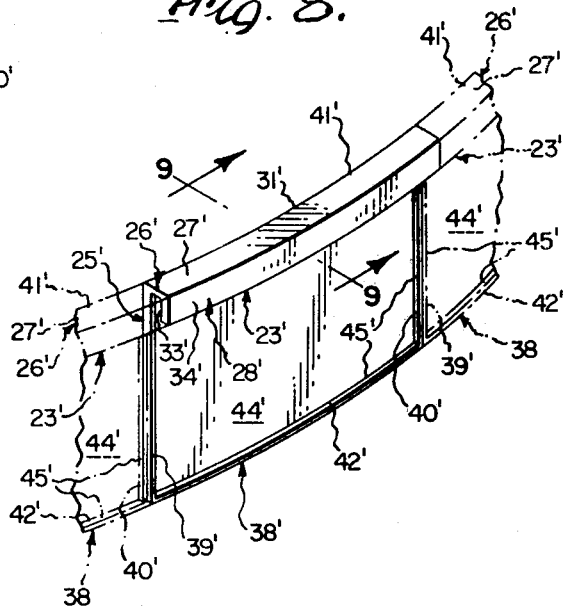
FIG. 8 is an enlarged perspective view of the outside of one of the upper cylindrical segments shown in FIG. 7 and particularly illustrating the configuration of such segment and the inventive stiffening member formed integrally therewith, and also depicting the relation of such segment to adjacent segments of similar construction illustrated in phantom.
Figure 9:
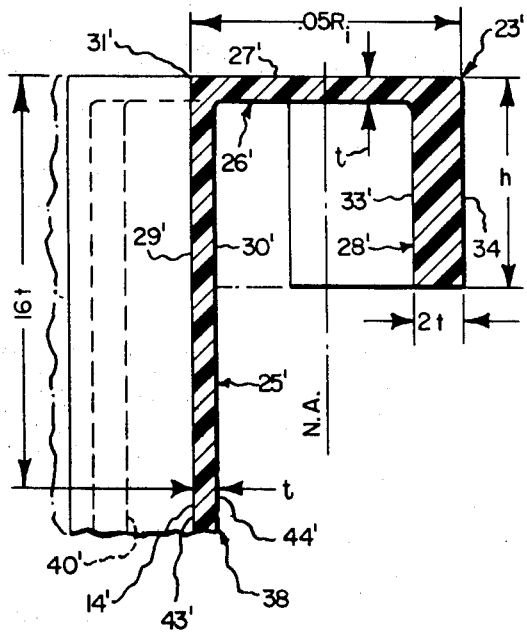
FIG. 9 is an enlarged fragmentary vertical sectional view of an upper part of the upper segment depicted in FIG. 8 and showing the cross-section of the stiffening member, this view being taken on line 9—9 of FIG. 8.

As best shown in FIGS. 7 and 8, each of upper segments 38 is similarly configured to have left and right vertical sides 39′, 40′, respectively; a horizontal arcuate top 41′ and bottom 42′; and inner and outer arcuate surfaces 43′, 44′ also occupying an inscribed angle of 60° and separated by the radial thickness ($t$) of the upper segment. However, each of upper segments 38 is additionally provided with a stiffening member 23′ at its top 41′. In FIG. 9, the stiffening member 23′ of each upper segment is shown as including an inner flange portion 25′, a web portion 26′, and an outer flange portion 28′, otherwise configured and dimensioned as before described.

Figure 10:
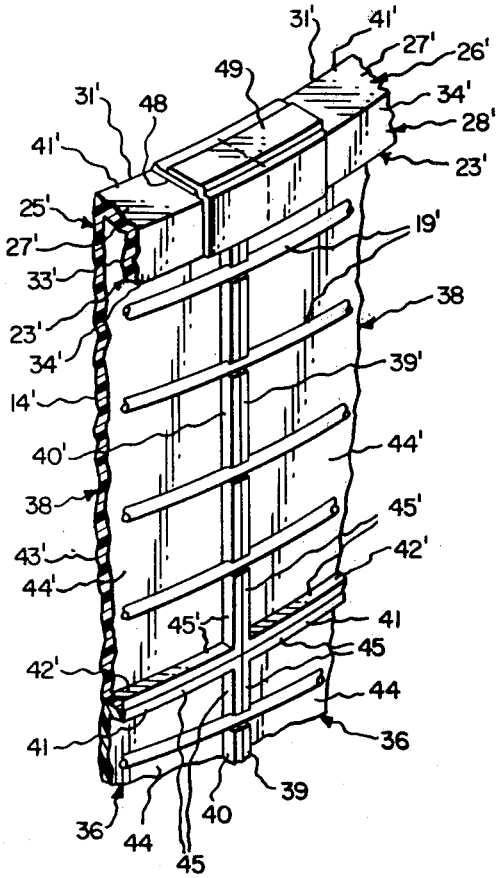
FIG. 10 is an enlarged fragmentary perspective view of the joint between two adjacent upper segments and showing the placement of battens on the adjacent stiffening members.

After the tank shown in FIG. 7 has been assembled, it is necessary to seal the joints between adjacent segments to rigidify the wall structure and to provide a functional liquid-impervious inner surface 14′. As best shown in FIG. 7, a plurality of battens or strips 46 of FRP material may be positioned over the horizontal and vertical joints between adjacent assembled segments and adhered with a suitable bonding resin to the inner surface 14′ of the tank to provide the necessary strength and seal. These battens are also shown applied to join the adjacent surfaces 29′ of the adjacent inner flange portions 25′ of adjacent upper segments 38. Additional plate-like battens 48, 49 may be resin bonded to the upper and outer surfaces 27′, 34′ of the web and outer flange portions 26′, 28′, respectively, to join these portions of adjacent stiffening members 23′ into an operative, circular, ring-like stiffening member, as best shown in FIG. 10.

In either type of described construction, the tank is initially designed to accommodate the intended service fluid and to have the requisite height, inner and outer diameters, and radial thickness. Thereafter, the length of the cable and the spacing between adjacent cable convolutions at various heights above the bottom may be calculated.

The stiffening member 23 may then be dimensioned, knowing the radial thickness (t) and the inner radius ($R_i$) of the wall structure. Inner flange portion 25 is preferably configured to be an upward integral continuation of the tank wall structure having a radial thickness (t) and a vertical height of sixteen times this thickness (t). The web portion 26 is dimensioned to have a vertical thickness of (t) and a maximum radial extent, from the inner surface 29 of inner flange portion 25 to the outer surface 34 of outer flange portion 28, of one-twentieth (.05) of the inner radius ($R_i$) of the tank. The outer flange portion 28 is selected to have a greater radial thickness equal to twice the thickness (t) of the wall structure. Hence, only the vertical height (h) of the outer flange portion remains unknown.

The minimum vertical moment of inertia for the stiffening member may be calculated according to the formula:

$$I_{Y_{min}} = \frac{w\,D_o^3}{8E_c}$$

where:

$I_{Y_{min}}$ = the minimum vertical moment of inertia of a section of the stiffening member $w$ = the anticipated wind load applied horizontally at the the upper end of the tank per unit of tank vertical height $D_c$ = the outer diameter of the wall structure $E_c$ = Young's modulus for fiberglass reinforced plastic in compression.

Knowing the value of $I_{Y_{min}}$, the vertical height ($h$) of outer flange portion 28 may be computed to locate the neutral axis (N.A.) of the vertical moment of inertia approximately midway between inner surface 29 and outer surface 34 such that the stiffening member will be equally capable of resisting both inward and outward flexure.

It should be clearly understood that the stated preferred dimensions of the stiffening member are merely intended to reduce the number of variables such that a person having ordinary skill in this art may more easily locate the neutral axis of the vertical moment of inertia by simply varying the vertical height (h) of the outer flange portion, and do not constitute a limitation on the claims unless expressed therein.

As used in the appended claims, the word "segment" refers to either a discrete separate part or an imaginary subdivision of the surface of revolution.

Bottom Ring Girder (FIGS. 11–19)

Under known design standards, an upstanding cylindrical tank, adapted to contain a liquid or a fluid material, may have to be designed to withstand a minimum horizontal seismic force ($F_s$) which applies an overturning seismic moment ($M_s$) to the tank. These standards contemplate that the total seismic force ($F_s$) is the sum of a first horizontal force ($F_{s_T}$) related to the dead load exerted by the weight of the tank and acting at its centroid ($z_T$) above the tank bottom, and a second horizontal force ($F_{s_L}$) related to the live load exerted by a dynamic impulse of the liquid exerted on the walls of the tank during a rapid horizontal translation of the bottom of the tank and acting at the centroid ($z_L$) of the effective weight of the liquid. Specifically, the anticipated magnitude of $F_s$ may be calculated as a function of the total weight of the tank ($W_T$), the weight of the contained liquid ($W_L$), the ratio ($k_m$) of the dynamic mass of the liquid to its total mass, and a constant (c) characteristic of the seismic conditions at the geographical location of the tank, according to the general formula:

$$F_s = F_{s_T} + F_{s_L} = c(W_T + k_m W_L)$$

The overturning seismic moment ($M_s$) may then be computed as the sum of moment ($M_T$) produced by the seismic force attributable to the tank ($F_{s_T}$) acting at its centroid ($z_T$) above the bottom of the tank, and the moment ($M_L$) produced by the seismic force attributable to the liquid ($F_{s_L}$) acting at its effective centroid ($z_L$) above the bottom of the tank. Accordingly, $$M_s = M_{s_T} + M_{s_L} = (F_{s_T})(z_T) + (F_{s_L})(z_L)$$

It will be appreciated by those skilled in this art that the wind load may produce a similar overturning moment on the tank.

In FIG. 11, the tank 10 illustrated in FIG. 1 is shown as containing a liquid and about to be subjected to a distributed trapezoidal load, such load schematically representing the aggregate lateral seismic force ($F_s$) exerted on the tank during an earthquake. As best shown in FIG. 12, the applied total seismic force ($F_s$) includes a uniformly distributed portion attributable to the dead load of the tank and having a resultant force ($F_{s_T}$) acting at its centroid ($z_T$) above the bottom, and a second portion having a generally trapezoidal cross-section attributable to the live load of the liquid and having a resultant force ($F_{s_L}$) acting at its effective centroid ($z_L$) above the bottom of the tank.

For purposes of further illustration, a cable-wrapped FRP tank having an inner radius of 120 inches, an outer radius ($R_O$) of 120.5 inches, filled with a liquid having a specific gravity of 1.70, and geographically located in an area where $c = 0.10$, may have to be designed to withstand application of seismic forces and moments of the following magnitude:

$F_{s_T} = 1053$ lbs. ($z_T = 13.5$ feet)
$F_{s_L} = 74,353$ lbs. ($z_L = 10.935$ feet)
$F_s = F_{s_T} + F_{s_L} = 75,406$ lbs.
$M_{s_T} = (F_{s_T})(z_T) = 12,519$ ft.-lbs.
$M_{s_L} = (F_{s_L})(zL) = 813,050$ ft.-lbs.
$M_s = M_{s_T} + M_{s_L} = 825,569$ ft.-lbs.

If, under application of the total horizontal seismic force ($F_s$), the foundation 13 is rapidly translated in a horizontal direction, the liquid will tend to remain at rest and exert a dynamic impulse on the trailing or left portion 50 of the side wall structure 11 and urge such structure to flex, as best viewed in the exaggerated schematic representation of FIG. 12. Hence, the liquid will act dynamically under such seismic translation to produce an upward tensile force in a leading or right portion 51 of the wall structure 11 and a downward compressive force in an opposite trailing or left 50 portion thereof, as may be viewed in the perspective schematic of FIG. 13. Since these tensile and compressive forces act in opposite directions and are separated by the diameter of the tank (FIGS. 12 and 13), an upwardly and inwardly curling torsional moment ($M_T$) will be applied to that portion of the wall structure which is in tension, and a downwardly and inwardly curling torsional moment ($M_c$) will be applied to that portion of the wall structure which is in compression, as schematically depicted in FIG. 14.

In the illustrative example given, application of the total seismic moment ($M_s$) will produce an additional seismic flexure stress ($f_s$) at the bottom of the side wall structure, calculable according to the equation:

$$f_s = \pm \frac{M\,c}{I} = \frac{M_s R_o}{\pi/64(D_o^4 - D_i^4)} = \pm 437.06 \text{ psi}$$

Referring to FIGS. 15 and 16, an improved tank 52, generally similar to the tank depicted in FIGS. 11 and 12, is shown as including an annular side wall structure 53; a bottom 54 (FIG. 16); and means, generally indicated at 55, arranged at the lower portion of the tank for resisting the additional flexure stress produced in the side wall structure by the application of an overturning moment to the tank. In FIGS. 16 and 17, such resisting means 55 is shown as broadly including annular upper and lower flange means 56, 58, respectively, and anchorage means 59.

The annular side wall structure 53 is specifically shown as being an upstanding thin-walled cylinder having an upper cylindrical part 60 and a lower cylindrical part 61. Upper cylindrical part 60 includes an inner cylindrical surface 62, a concentric outer cylindrical surface 63 spaced from inner surface 62 by the radial thickness ($t$) of the upper part, and an annular first flange portion 64 extending radially outwardly from its lower end 65. First flange portion 64 has horizontal upper and lower surfaces 66, 68, respectively, and is preferably formed integrally with upper cylindrical part 60.

Lower cylindrical part 61 similarly includes an inner cylindrical surface 69 and a concentric outer cylindrical surface 70 spaced from inner surface 69 by the radial thickness ($t$) of lower part 61; and further includes an integral second annular flange portion 71 extending radially outwardly from its upper end 72, and an integral third annular flange portion 73 extending radially outwardly from its lower end 74. The second annular flange portion 71 has upper and lower annular surfaces 75, 76, respectively. Similarly, the third flange portion 73 has upper and lower annular surfaces 78, 79, respectively. Preferably, the vertical height of lower cylindrical part 61 may be between sixteen and eighteen times its radial thickness ($t$).

As best shown in FIG. 17, the lower end 65 of the upper cylindrical part 60 is arranged or aligned to engage the upper end 72 of lower cylindrical part 61 to form the cylindrical tank wall structure 53. In this manner, the upper surface 75 of the second annular flange portion 71 will engage or contact the lower surface 68 of the first flange portion 64. The upper flange means 56 includes first and second flange portions 64, 71, respectively, and the lower end 65 of upper part 60.

The tank bottom 54 is shown as being a circular plate-like member having a horizontal lower face 80 arranged in downwardly thrusting relation to the foundation or support 13, a horizontal upper face 81, an integral annular marginal portion 82 extending radially outwardly under the third flange portion 73 beyond the outer surface 70 of the lower cylindrical part 61 and beyond third flange portion 73, and an integrally-formed vertical cylindrical portion 83 upstanding from the outermost part of marginal portion 82 to be concentrically arranged with lower cylindrical part 61 and having inner and outer cylindrical surfaces 84, 85, respectively. The lower end 74 of lower cylindrical part 61 is shown engaging a portion of the bottom such that the lower surface 79 of third flange portion 73 engages or contacts an annular portion of the bottom upper face 81.

In the preferred embodiment shown and described, the lower flange means 58 includes the third flange portion 73, the bottom marginal portion 82, and the cylindrical portion 83 upstanding therefrom.

The anchorage means 59 broadly includes a plurality of circularly-spaced inverted L-shaped angle sections or contact members 86, and a corresponding plurality of bolt means 88 fixed to the support 13 and arranged to act on the upper surface 66 of the upper flange means 56. Each contact member 86 includes a horizontal contact plate 89 having an upper surface 90 arranged to be acted upon by one of the bolt means and a lower surface 91 contacting or engaging the upper surface 66 of first flange portion 64 for distributing the downward force exerted by the bolt means over the area of contact between plate lower surface 91 and first flange portion upper surface 66, and an integral vertical leg 92 depending from an outermost part of plate 89 and having a lower end 93 arranged to engage or contact a portion of the support 13.

Each of the bolt means 88 includes an anchor bolt 94 having its lower hooked end 95 suitably embedded or secured in foundation 13 and having its vertical threaded end portion 96 extending upwardly through a hole 98 provided in plate 89, and a nut 99 arranged on the threaded end portion 96 and rotatable to engage or act on the upper surface 90 of the contact plate. Each of nuts 99 may be suitably tightened to act directly on the plate upper surface 90 for exerting a downward force on the upper surface 66 of the upper flange means 56, which force will be distributed over the area of contact between plate lower surface 91 and the first flange portion upper surface 66 and which may be represented as having a circularly-segmented downwardly-acting resultant force ($F_t$) as best depicted in FIG. 19.

The annular trough between cylindrical surfaces 70 and 84 and the upper surface 78 of the third flange portion is filled with a resin-sand mixture 100 in which the lower end of the steel cable is embedded and secured. The intermediate portion of the cable is helically wound about the outer surface of the cylindrical side wall structure such that the vertical spacing between adjacent cable convolutions 101 increases with height above the tank bottom.

In FIG. 17, laminated corner battens 102 are shown applied to the inner cylindrical surface and bottom of the tank to join and seal the inner cylindrical surfaces 62, 69 of the upper and lower cylindrical parts 60, 61, respectively, and the annular side wall structure to the bottom.

In the preferred embodiments, an inverted U-shaped plastic stiffening member 103 is positioned beneath each angle section 86 to engage the upper surface 78 of the third flange portion and the lower surface 76 of the second flange portion to prevent localized buckling of the upper flange means when nut 99 is tightened to exert a downward force thereon.

While the wall structure has been described as including upper and lower cylindrical parts, it should be readily apparent to one skilled in this art that an improved tank incorporating the inventive resisting means may also be provided with a unitary or sectional wall structure.

After the tank 52 has been initially designed to have the required capacity and to accommodate the intended service fluid, the resisting means 55 may be designed and suitably dimensioned. Anticipating that a seismic force ($F_s$) or a wind force may be applied to the tank from any direction, the resisting means is designed by considering that a leading portion 51 of the wall structure will be placed in tension and that a trailing portion 50 will be placed in compression, and by dimensioning the resisting means to withstand the greater additional flexure stress attributable to the rotational or torsional moments applied thereto at the point of maximum compression (FIG. 18) or at the point of maximum tension (FIG. 19).

Referring to FIG. 18, the seismic flexure stress ($f_s$) is assumed to be evenly distributed across the thin radial thickness ($t$) of the trailing portion 50 of the side wall structure to produce a maximum downward unit compressive force ($f_c$) acting at the center of the wall structure and which may be calculated according to the equation:

$$f_c = (f_s)(t)$$

Thereafter, the maximum rotational or torsional moment ($M_c$) applied to the compressive side may be calculated by considering that the maximum net downward compressive force ($f_c$) in the side wall structure will be opposed by an equal distributed upward force exerted by the foundation on a portion of the bottom lower face 80 between inner surface 69 and outer surface 85, such opposing force having an upward resultant force ($F_c$) applied to bottom lower face 80 approximately midway between surfaces 69 and 85. The maximum torsional or rotational moment in the compression side ($M_c$) may be calculated by considering that the downward compressive force ($f_c$) will act at an arm distance ($X_c$) from the point of application of the upward resultant force ($F_c$) to exert a clockwise moment ($M_c$) on the resisting means. Accordingly, $$M_c = (f_c)\ (x_c)$$

Thereafter, the upper and lower flange means 56, 58, respectively, may be suitably spaced and dimensioned to locate the centroid (Z) of the polar moment of inertia ($I_p$) of the upper and lower flange means and the wall structure therebetween approximately equidistant from each of the furthermost fibers thereof, namely, points A and B on the upper flange means and points C and D of the lower flange means.

The maximum flexure stress on the compression side ($M_c$) at each of points A, B, C and D may be calculated according to the equation:

$$s_{c_{max}} = \frac{M_c R_y C}{I_p}$$

where: $R_y$ is the radius to the centroid, and C is the distance from the centroid to the furthest point of the upper and lower flange means (point A, B, C or D).

Referring to FIG. 19, the seismic flexure stress ($f_s$) is similarly assumed to be evenly distributed across the radial thickness ($t$) of the leading portion of the wall structure to produce a maximum unit tensile force ($f_t$) acting upwardly at the center of the wall structure and which may be calculated according to the equation:

$$f_t = (f_s)\ (t)$$

On the tension side, the maximum upward tensile force ($f_t$) in the leading portion 51 will be resisted by an opposite downward force exerted by the anchorage means acting across the area of contact between upper surface 66 and plate lower surface 91, such force being represented as having a downward resultant ($F_t$) acting at the center of such area of contact and spaced from the upward tensile force ($f_t$) by an arm distance ($X_t$). Hence, the magnitude of the rotational moment ($M_t$) on the tension side may be calculated according to the equation:

$$M_t = (f_t)\ (X_t)$$

The maximum flexure stress ($s_t$) on the tension side at each of furthermost points A, B, C and D may also be calculated according to the equation:

$$s_{t_{max}} = \frac{M_t R_y c}{I_p}$$

In the schematic illustrations of FIGS. 18 and 19, the effective moment arm on the tension side ($x_t$) is greater than the corresponding moment arm ($x_c$) on the compression side. Hence, the maximum torsional moment on the tensile side ($M_t$) will be greater than the maximum torsional moment on the compression side ($M_c$). Accordingly, the maximum flexure stress on the tension side ($s_t$) at points A, B, C and D will be greater than on the compression side ($s_c$) and this greater value should be employed in the design of the anchorage means.

The radius ($R_a$) of the anchor bolt circle may then be selected and the unit load ($f_a$) thereon computed according to the equation:

$$f_a = \frac{M_x}{\pi R_a^2}$$

Since the contact plate lower surface 91 will exert the downward force ($F_t$) on the upper flange means, a force ($F_t'$) of like magnitude but opposite direction will be exerted on the plate at the same point. This upward force ($F_t'$) acting at a distance (L) from the center of leg 92 will be resisted by a downward force ($F_b$) exerted by the bolt means acting on plate upper surface 90 at a distance ($a$) from the center of leg 92. Hence, the maximum upward pull ($F_b$) on the bolts may be calculated by considering the moments about the center of leg 92. Accordingly, $$P_b = \frac{F_t'(L)}{a} = \frac{F_t(L)}{a}$$

Thereafter, the minimum number, size and spacing of the bolt means may be calculated.

For the convenience of those skilled in the art, but not to be construed as a limitation on the claims appended hereto, the vertical thickness of the first, second, and third flange portions, 64, 71 and 82, respectively; the vertical thickness of the bottom marginal portion 82; and the radial thickness of cylindrical portion 83 may severally be dimensioned to be equal to the radial thickness ($t$) of the side wall structure. While this configuration is arbitrary, it serves to reduce the number of variables in dimensioning and spacing the upper and lower flange means to position the centroid (Z) of its cross-section equidistant from furthermost points A, B, C and D.

While preferred embodiments of the invention have been shown and described, it should be clearly understood by a person having ordinary skill in this art that various changes and modifications may be made without departing from the spirit of the invention which is defined by the following claims.

What is claimed is:

1. In an upstanding fiberglass reinforced plastic tank including an open-top substantially cylindrical side wall structure having an upper portion formed by assembling a plurality of cylindrical segments together, the improvement which comprises:

a stiffening member joining the upper ends of adjacent segments for increasing the flexure resistance of the assembled side wall structure, said stiffening member including an inner flange portion secured to each of said segments and extending upwardly therefrom, each of said inner flange portions being configured as a segment of a cylinder;

a web portion formed integrally with and extending radially outwardly from an upper part of each of said inner flange portions;

an outer flange portion configured as a segment of a cylinder, formed integrally with and depending from an outer part of each of said web portions, and arranged in spaced concentric relation with its associated inner flange portion; and at least one plate bonded to at least one of said portions of each of an adjacent pair of segments;

whereby said plates may join such portions of adjacent segments together to provide a continuous composite stiffening member about the open top of said tank to increase the flexure resistance of said assembled side wall structure.

2. A tank according to claim 1 wherein a first such plate is bonded to the concave inner surface of each of two adjacent inner flange portions.

3. A tank according to claim 1 wherein a second such plate is bonded to the convex outer surface of each of two adjacent outer flange portions.

4. A tank according to claim 1 wherein a third such plate is bonded to the upper surface of each of two adjacent web portions.

* * * * *